US011827434B2

(12) United States Patent
DelRosario, II

(10) Patent No.: US 11,827,434 B2
(45) Date of Patent: Nov. 28, 2023

(54) INSECT PROOF CONTAINER LID SYSTEMS

(71) Applicant: Ernest DelRosario, II, Sacramento, CA (US)

(72) Inventor: Ernest DelRosario, II, Sacramento, CA (US)

( * ) Notice: Subject to any disclaimer, the term of this patent is extended or adjusted under 35 U.S.C. 154(b) by 0 days.

(21) Appl. No.: 15/387,657

(22) Filed: Dec. 22, 2016

(65) Prior Publication Data

US 2018/0178956 A1 Jun. 28, 2018

(51) Int. Cl.
*B65D 43/02* (2006.01)
*B65D 51/24* (2006.01)

(52) U.S. Cl.
CPC ..... *B65D 51/246* (2013.01); *B65D 43/0202* (2013.01); *B65D 2543/00296* (2013.01)

(58) Field of Classification Search
CPC ..... B65D 43/0202; B65D 51/246; B65D 2543/00296
USPC ..... 220/200, 212
See application file for complete search history.

(56) References Cited

U.S. PATENT DOCUMENTS 1,328,652 A * 1/1920 Ehlers ..... B65D 51/32 D9/454
1,682,571 A * 8/1928 Horan ..... A47G 21/14 224/233
1,834,085 A * 12/1931 Bloom ..... B65D 7/24 229/125.17
2,106,313 A * 1/1938 Amrine ..... A47G 19/186 401/128
2,149,255 A * 3/1939 Fader ..... A47L 13/58 15/263
2,149,698 A * 3/1939 Humphrey ..... B65D 51/246 221/256
2,175,735 A * 10/1939 Banks ..... B65D 77/283 215/388
2,533,354 A * 12/1950 Comfort ..... B44D 3/123 220/697
4,183,444 A * 1/1980 English ..... B65D 51/24 220/200
4,328,904 A * 5/1982 Iverson ..... B65D 51/24 220/200
4,525,892 A * 7/1985 Vayas ..... A47L 13/58 15/263
4,736,867 A * 4/1988 Feimer ..... A47J 36/06 220/212.5
5,586,676 A * 12/1996 Lynd ..... A47G 21/145 215/228
6,039,368 A * 3/2000 Kowalczyk ..... A01K 1/0114 294/1.3
6,173,851 B1 * 1/2001 Hague ..... A61J 7/003 206/370

(Continued)

FOREIGN PATENT DOCUMENTS

GB 2412654 A * 10/2005 ..... A47G 19/186

*Primary Examiner* — Joshua E Rodden
(74) *Attorney, Agent, or Firm* — Argus Intellectual Enterprise; Jordan Sworen; Daniel Enea

(57) ABSTRACT

The present invention relates to a spoon attachable container lid, including at least one main frame for fitting over an opened top of a container, a means for sealing the main frame on the opened top of the container, a spoon and an opening in the main frame for fitting the spoon. The complete system is made of food grade plastic and reduces the chances of contamination during eating or serving the food items kept in the container.

2 Claims, 2 Drawing Sheets

(56) References Cited

U.S. PATENT DOCUMENTS

| | | | | |
|---|---|---|---|---|
| 6,257,441 | B1 * | 7/2001 | Maley | A45F 3/16 220/212 |
| 7,644,832 | B1 * | 1/2010 | Tsengas | B65D 51/246 220/796 |
| 8,302,798 | B2 * | 11/2012 | Moss | B65D 43/0212 220/229 |
| 9,169,049 | B2 * | 10/2015 | Mayo | B65D 51/32 |
| D751,392 | S * | 3/2016 | Wu | D7/392.1 |
| 9,635,975 | B2 * | 5/2017 | Walker | A47J 36/025 |
| 10,299,612 | B2 * | 5/2019 | Dean | A47G 21/00 |
| 10,518,949 | B2 * | 12/2019 | Becker | B65D 43/0231 |
| 2004/0074912 | A1 * | 4/2004 | Johnson | B65D 43/0202 220/793 |
| 2008/0078762 | A1 * | 4/2008 | Iyer | B65D 47/2031 220/229 |
| 2012/0091142 | A1 * | 4/2012 | Jamison | A47G 19/2211 220/200 |
| 2016/0001960 | A1 * | 1/2016 | Heiberg | B65D 51/246 220/212 |
| 2020/0130905 | A1 * | 4/2020 | Bianco | A47G 19/186 |

* cited by examiner

INSECT PROOF CONTAINER LID SYSTEMS

BACKGROUND OF THE INVENTION

1. Field of the Invention

The present invention relates generally to the field of food container lids and more specifically relates to insect proof container lid systems.

2. Description of the Related Art

A container is a basic tool, consisting of any device creating a partially or fully enclosed space that can be used to contain, store, and transport objects or materials. Items kept inside of a container are protected by being inside of its structure. The term is most frequently applied to devices made from materials that are durable and at least partly rigid. It is a common practice for people to leave the food container either totally or partially open after serving food. Also, while travelling it is difficult to keep the food container closed along with the serving spoon. The chances of not finding a serving spoon at times and the serving spoon being lost are also high. This is not desirable.

Various attempts have been made to solve problems found in food container lid art. Among these are found in: U.S. Pat. Nos. 7,464,475; 8,833,584; and 8,376,179. This prior art is representative of food container lids.

None of the above inventions and patents, taken either singly or in combination, is seen to describe the invention as claimed. Thus, a need exists for a reliable insect proof container lid system, and to avoid the above-mentioned problems.

BRIEF SUMMARY OF THE INVENTION

The present invention advantageously fills the aforementioned deficiencies by providing a container lid with spoon attachment means. The present invention is superior to other systems in that it effectively reduces the chances of losing a serving spoon as well as reducing the chances of contamination while the serving spoon is placed in the container.

Insect proof container lid systems provides a container lid with spoon attachment means. The primary intent of the present invention is to provide a spoon fitted container lid providing a solution to the problem of leaving a partial opening between the lid of a container and the food container with the serving spoon extending outwardly. Insect proof container lid systems provides a spoon attachable container lid, including at least one main frame for fitting over an opened top of a container, a means for sealing the main frame on the opened top of the container, a spoon and an opening in the main frame for fitting the spoon. The device comprises a food grade material.

The features of the invention which are believed to be novel are particularly pointed out in the specification. The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, insect proof container lid systems, constructed and operative according to the teachings of the present invention.

The various embodiments of the present invention will hereinafter be described in conjunction with the appended drawings, wherein like designations denote like elements.

DETAILED DESCRIPTION

The present invention is directed to an insect proof container lid system comprising a spoon attachable container lid, including at least one main frame for fitting over an opened top of a container, a means for sealing the main frame on the opened top of the container, a spoon and an opening in the main frame for fitting the spoon. The complete system is made of food grade plastic and reduces the chances of contamination during eating or serving the food items kept in the container.

Figure 1:
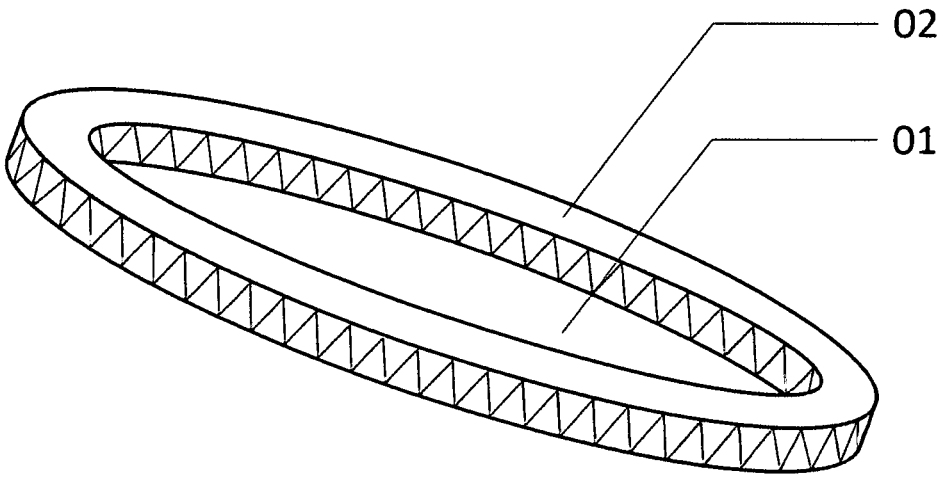
FIG. 1 is a perspective view of an insect proof container lid systems comprising a container lid according to an embodiment of the present invention.
Figure 2:
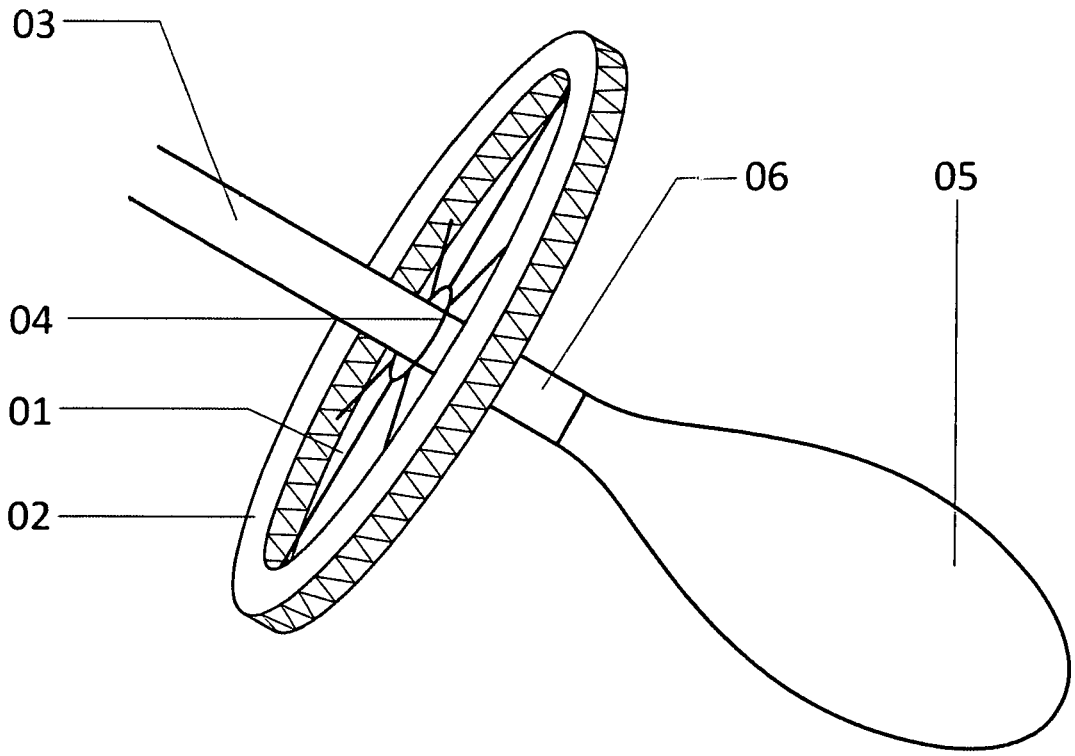
FIG. 2 is a front perspective view illustrating the insect proof container lid systems comprising a spoon that may be attached to the container lid according to an embodiment of the present invention.

Referring now to the drawings, there is shown in FIGS. 1-2, the insect proof container lid systems comprising a container lid and removably attachable spoon 03. The spoon 03 comprises a head 05 and a shaft 03. The container lid comprises a main frame 01 having a seal 02. The lid further comprises an opening 04 in the main frame 01 for fitting the spoon 03. In an embodiment the present invention, the spoon, attachable container lid, including the main frame made of food grade material surrounded by the means for sealing the main frame on the opened top of the container, and the spoon are made of food grade. Further, the spoon 03 is fitted in the opening 04 on the main frame 01 through the shaft of the spoon.

In a preferred embodiment the present invention provides a container lid with spoon attachment means. The main frame is made of food grade plastic, circular in shape and surrounded with the seal. The spoon comprises a head and a shaft. The spoon may be secured by the shaft in the opening on the main frame via the seal. Further, the opening on the main frame facilitates free movement of the spoon. The exact specifications, materials used, and method of use of the insect proof container lid system may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

I claim:

1. A spoon attachable container lid, comprising;

a container lid having a main frame and an opening disposed in a center of the main frame, wherein a shaft of a serving spoon is disposed within the opening;

a seal disposed on an exterior wall of the main frame having an upper side and a lower side, wherein the seal is configured to seal the lid to a serving container by fitting over an opened top of the serving container;

wherein the main frame is disposed entirely within the boundary between the upper side and lower side of the seal and the seal comprises a greater thickness than a thickness of the main frame;

wherein the seal, the opening and the main frame comprise a circular cross section;

wherein the serving spoon and main frame are composed of a food grade plastic;

wherein the opening facilitates free movement of the spoon.

2. The spoon attachable container lid of claim 1, wherein an exterior side of the exterior wall forms the outermost edge of the spoon attachable container lid.

* * * * *